US008851850B2

(12) United States Patent
Hoyland et al.

(10) Patent No.: US 8,851,850 B2
(45) Date of Patent: Oct. 7, 2014

(54) ANNULUS FILLER ASSEMBLY FOR A ROTOR OF A TURBOMACHINE

(75) Inventors: Matthew A. C. Hoyland, Chesterfield (GB); Dale E. Evans, Derby (GB); Ian C. D. Care, Derby (GB)

(73) Assignee: Rolls-Royce PLC, London (GB)

( * ) Notice: Subject to any disclaimer, the term of this patent is extended or adjusted under 35 U.S.C. 154(b) by 903 days.

(21) Appl. No.: 12/968,962

(22) Filed: Dec. 15, 2010

(65) Prior Publication Data

US 2011/0146299 A1 Jun. 23, 2011

(30) Foreign Application Priority Data

Dec. 23, 2009 (GB) ..... 0922422.1

(51) Int. Cl.
*F01D 5/02* (2006.01)
*F01D 11/00* (2006.01)

(52) U.S. Cl.
CPC ..... *F01D 11/006* (2013.01); *F01D 11/008* (2013.01); *F05D 2220/36* (2013.01)
USPC ..... 416/204 R

(58) Field of Classification Search
CPC ..... F01D 5/30; F01D 5/3007; F01D 5/3015; F01D 5/32; F01D 5/323; F01D 5/326
USPC ..... 416/204 R, 219 R, 220 R, 221
See application file for complete search history.

(56) References Cited

U.S. PATENT DOCUMENTS 3,712,757 A * 1/1973 Goodwin ..... 416/245 R
2003/0012654 A1 1/2003 Strassberger et al.
2005/0265847 A1* 12/2005 Butt et al. ..... 416/204 R
2009/0208335 A1* 8/2009 Bottome ..... 416/179
2010/0040472 A1* 2/2010 Read et al. ..... 416/204 R

FOREIGN PATENT DOCUMENTS

| | | | |
|---|---|---|---|
| EP | 2 090 749 | A2 | 8/2009 |
| EP | 2 154 334 | A2 | 2/2010 |
| EP | 2 253 802 | A2 | 11/2010 |
| GB | 2 171 151 | A | 8/1986 |
| GB | 2 425 155 | A | 10/2006 |
| WO | WO 93/21425 | | 10/1993 |

OTHER PUBLICATIONS

British Search Report issued in British Application No. GB0922422.1 on Mar. 17, 2010.
Jul. 9, 2014 European Search Report issued in European Patent Application No. EP 10 19 5223.

* cited by examiner

*Primary Examiner* — Edward Look
*Assistant Examiner* — Jeffrey A Brownson
(74) *Attorney, Agent, or Firm* — Oliff PLC

(57) ABSTRACT

An annulus filler assembly for a rotor of a turbomachine, the assembly comprising: an annulus lid (56) having a radially outwardly facing surface (58) for forming an inner wall of a flow annulus of the rotor and a radially inwardly facing surface; and a frame for supporting the annulus lid (40), the frame being mountable to a disc of the rotor such that the annulus lid (56) is spaced away from the disc, wherein the frame (40) comprises a connection portion (46) which, in use, passes through an aperture (60) in the annulus lid (56) from the radially inwardly facing surface towards the radially outwardly facing surface (58) such that at least a portion of the connection portion (46) is visible from the radially outwardly facing surface (58); the assembly further comprising a locking element (68) which locks the connection portion (46) to the annulus lid (56) via the visible portion of the connection portion (46).

13 Claims, 7 Drawing Sheets

ANNULUS FILLER ASSEMBLY FOR A ROTOR OF A TURBOMACHINE

The present invention relates to an annulus filler assembly for a turbomachine, in particular the bypass fan assembly of a turbo fan engine.

BACKGROUND

A conventional turbo fan engine uses the core engine to drive a bypass fan mounted near the engine intake. Fan blades on the bypass fan drive a core flow into the core engine and a bypass flow around the core engine. The bypass flow combines downstream with the core exhaust flow to provide propulsive thrust.

A casing assembly extends around the outside of the fan to provide an outer wall of a flow annulus through the fan. The fan blades themselves are not normally provided with blade platforms, and so a number of separate circumferential wall inserts or "annulus fillers" are mounted on the outside of the fan rotor disc, in between the fan blades, to form the inner wall of the flow annulus through the fan.

The annulus fillers are typically mounted on the fan rotor disc using a hook arrangement, such as the one described in International Application PCT/GB93/00372 (published as WO93/21425). Here, each annulus filler is provided with a pair of hooks which extend radially inwardly from the filler to engage correspondingly shaped hooks provided on the outer face of the fan rotor disc. The hooks on the filler must be maintained in axial engagement with the hooks on the fan rotor disc, and one or more separate thrust rings is typically provided for this purpose.

A similar configuration is shown in FIG. 1. A blade 2 is connected to a disc 4 at a radially outer face of the disc 4 by an interlocking configuration, such as a dovetail joint. A plurality of blades 2 are assembled onto the disc 4 around the circumference of the disc 4 to form a rotor. As described previously, an annulus filler 6 is provided between adjacent blades 2 so as to form the inner wall of the flow annulus through the fan. The annulus filler 6 is mounted to the disc by a pair of annulus filler hooks 8, 10 which engage with correspondingly shaped disc hooks 12, 14. The hook arrangement provides radial retention of the annulus filler 6 against centrifugal loads experienced during operation of the rotor. A plurality of annulus fillers 6 are provided between each pair of adjacent blades 2. To ensure that the annulus filler hooks 8, 10 are maintained in engagement with the disc hooks 12, 14, the axial position of the annulus filler 6 with respect to the disc 4 is fixed by a nose cone support ring 16. The nose cone support ring 16 covers the full circumference of the rotor and retains each of the annulus fillers 6. The nose cone support ring 16 is connected to an arm 18 of the disc and also to an arm 20 of the annulus filler 6. Consequently, the axial position of the annulus filler 6 is fixed so that the hooks remain engaged. During operation, the nose cone support ring 16 also bears a component of the centrifugal load of the annulus filler 6 which creates hoop stress in the nose cone support ring 16.

The nose cone support ring also functions as the primary fixation point for a nose cone of the turbomachine. The nose cone creates smooth airflow into the fan, particularly at the root of the blades, and also must be capable of withstanding bird strikes and preventing build up of ice. The nose cone 22 is located on an annular shoulder 24 of the nose cone support ring 16 and is connected at positions around the nose cone support ring 16 via abutting radial flanges 26.

The connection between the nose cone support ring 16 and the nose cone 22 is enclosed by a cover portion 28. The forward (upstream) axial end of the annulus filer 6 has a tongue portion which is received under a lip portion 32 of the cover portion 28. A similar arrangement is provided at the opposite axial end for mating with a rotating seal element 34.

A hook-type mounting arrangement such as the one described in International Application PCT/GB93/00372 and as shown in FIG. 1 requires that dedicated, load-bearing attachment features such as hooks must be formed on the outside of a forged fan rotor disc and this adds to the cost and complexity of manufacturing the fan rotor disc.

In addition, safely engaging the hooks with one another may be difficult and time-consuming because, in practice, the hooks tend to be obscured from view by the adjacent blades and by the annulus filler itself during assembly. Failure to safely engage the hooks increases the risk of annulus filler detachment under a centrifugal load during rotation of the fan.

During a bird strike or fan blade off (FBO) event, a fan blade may be deflected and apply a circumferential load to an adjacent annulus filler. Tests have shown that some prior art annulus filler inserts secured using hook style fixings may be vulnerable to detachment under these circumferential loads.

The present invention seeks to provide an improved annulus filler assembly, and in particular seeks to provide an annulus filler assembly which addresses one or more of the specific problems referred to above.

STATEMENTS OF INVENTION

According to a first aspect of the invention there is provided an annulus filler assembly for a rotor of a turbomachine, the assembly comprising: an annulus lid having a radially outwardly facing surface for forming an inner wall of a flow annulus of the rotor and a radially inwardly facing surface; and a frame for supporting the annulus lid, the frame being mountable to a disc of the rotor such that the annulus lid is spaced away from the disc, wherein the frame comprises a connection portion which, in use, passes through an aperture in the annulus lid from the radially inwardly facing surface towards the radially outwardly facing surface such that at least a portion of the connection portion is visible from the radially outwardly facing surface; the assembly further comprising a locking element which locks the connection portion to the annulus lid via the visible portion of the connection portion.

The annulus filler assembly of the present invention therefore provides allows visual inspection of the connections between the constituent components at each stage of assembly. This therefore removes the potential for mal-assembly which could lead to the disconnection of the annulus filler assembly when in service.

The frame may be narrower than the annulus lid in a circumferential aspect.

The frame may comprise a hook portion for mounting the frame to the disc of the rotor.

The annulus lid and frame may be constructed from different materials.

The frame may be constructed from metal.

The metal frame is advantageous in the event of a fan blade off event. Here, the metal frame provides some degree of flexibility which would allow the annulus filler assembly to rotate when forced by a deflecting blade. Also if the annulus filler assembly were to fail as a result of a deflecting blade, it is likely that only the annulus lid would be disconnected. Therefore the mass and energy of the debris will be reduced, thus limiting damage.

The annulus lid may be constructed from a composite material.

The connection portion and locking element may comprise complementary interlocking surfaces which when interlocked prevent the connection portion from being withdrawn through the aperture.

The connection portion and locking element may form a dovetail joint.

The aperture may comprise first and second openings through which first and second portions of the connection portion pass and wherein the locking element is inserted between the first and second portions of the connection portion.

The annulus lid may comprise a recess formed in its radially outwardly facing surface for receiving the locking element such that the locking element and radially outwardly facing surface form a substantially continuous inner wall of the flow annulus.

The recess may be a channel extending in an axial direction along the radially outwardly facing surface and the locking element may be an elongate member slidably received within the channel.

The first and second openings may be positioned either side of the recess.

The locking element may be flexible.

The locking element may lock a plurality of connection portions to the annulus lid.

According to a second aspect of the invention there is provided a method of assembling a rotor, the method comprising: providing a plurality of annulus filler assemblies as claimed in any one of the preceding claims; coupling the frames of the annulus filler assemblies to a disc of the rotor; coupling a plurality of blades to the disc between adjacent frames; locating the annulus lid of the annulus filler assembly on the frame such that the connection portion passes through the aperture in the annulus lid; and inserting the locking element into the connection portion so as to lock the connection portion to the annulus lid.

BRIEF DESCRIPTION OF THE DRAWINGS

For a better understanding of the present invention, and to show more clearly how it may be carried into effect, reference will now be made by way of example, to the following drawings, in which.

DETAILED DESCRIPTION

Figure 1:
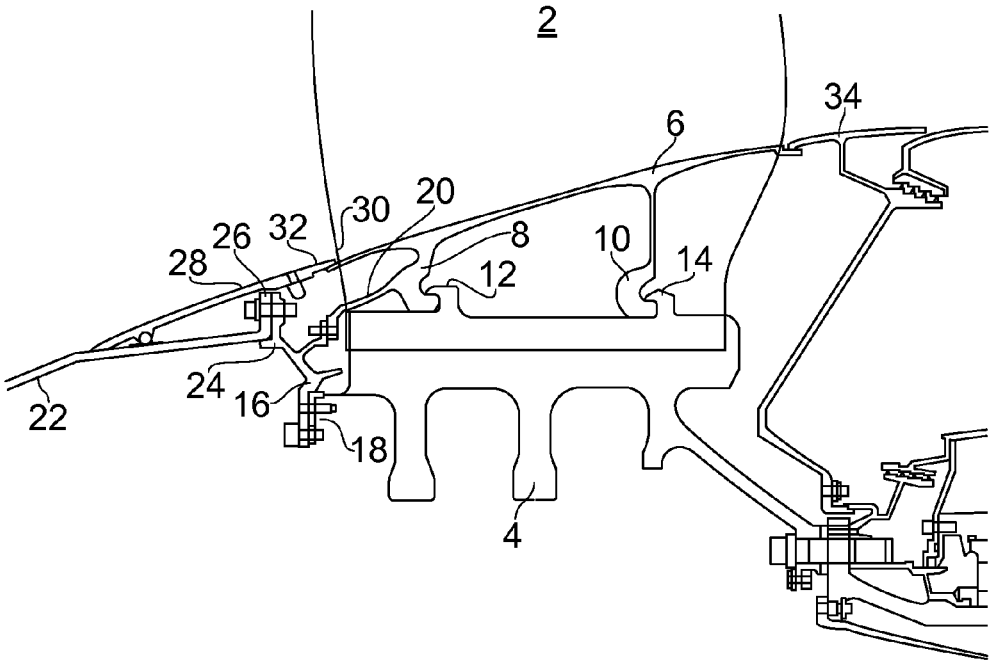
FIG. 1 is a side cross-sectional view of a prior art annulus filler assembly.
Figure 2:
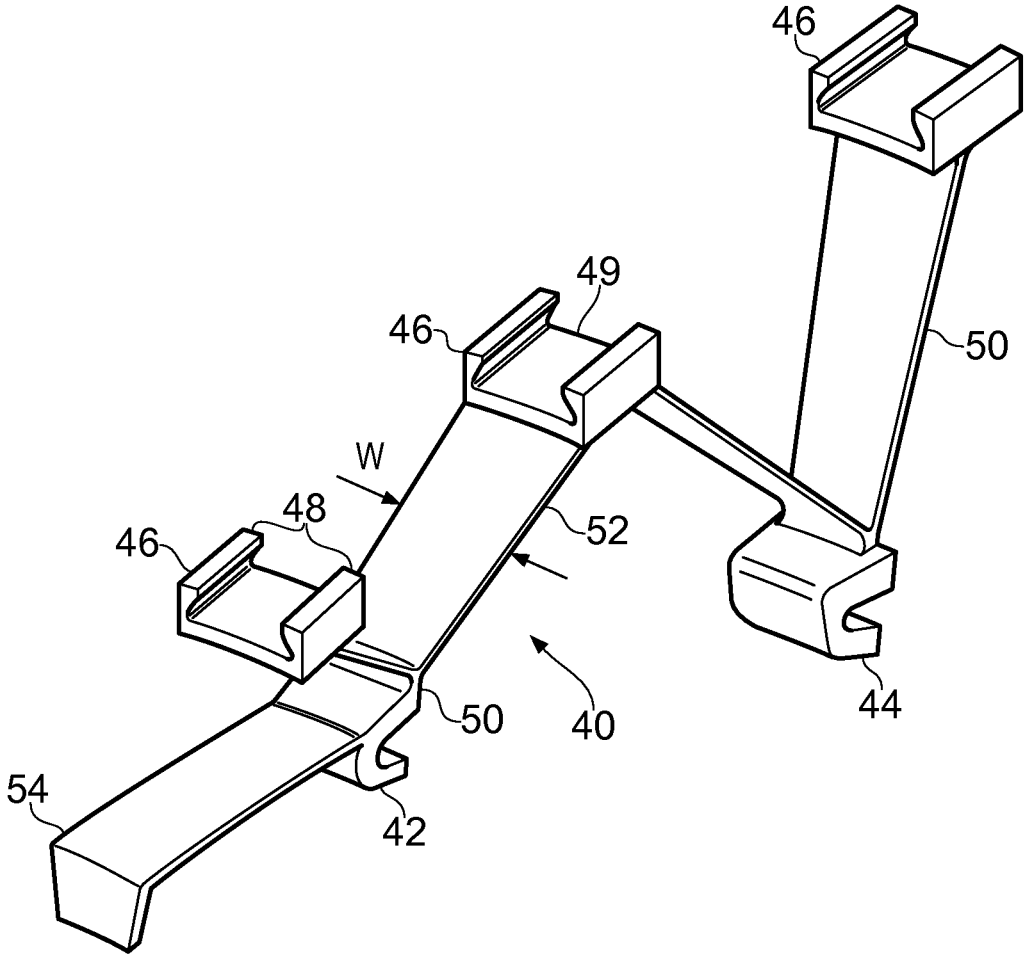
FIG. 2 is a perspective view of an annulus filler assembly in accordance with a first aspect of the invention in a first stage of assembly.

FIG. 2 shows an annulus filler assembly in accordance with a first aspect of the invention. The annulus filler assembly comprises a frame 40 having a first hook element 42 and a second hook element 44 for attachment to correspondingly shaped hook elements on a disc; for example the hooks 12, 14 shown in FIG. 1.

The frame 40 comprises a pair of upstanding members 50 extending substantially from the first and second hook elements 42, 44 and a bridging member 52 which joins the first and second hook elements 42, 44 together. The frame 40 is constructed from sheet metal and therefore the bridging member 52 provides a degree of flexibility between the first and second hook elements 42, 44 which allows the first and second hook elements 42, 44 to engage with the hooks of the disc.

The frame 40 comprises three connection portions 46 which are supported above the first and second hook elements 42, 44. Two of the connection portions 46 are supported on the pair of upstanding members 50 and the third is supported by the bridging member 52. Although three connection portions 46 are shown in FIG. 2, any appropriate number of connection portions 46 and a correspondingly arranged frame may be provided, in alternative applications.

Each connection portion 46 has a cross-section which forms one half of an interlocking connection. For example, as shown in FIG. 2, each connection portion 46 has two shoulders 48 and a recess 49 therebetween, forming a female half of a dovetail joint.

An arm 54 extends axially from the first hook element 42. The arm 54 is connected to or abuts with a thrust ring, such as the nose cone support ring 16 shown in FIG. 1, which acts to position the annulus filler axially and to maintain engagement of the first and second hook elements 42, 44 with the hooks of the disc.

The width w of the frame 40 is narrower than the gap between adjacent blades. This allows the frame 40 to be engaged with the disc prior to fitting of the blades and subsequent disassembly can be performed without removal of the frame 40 from the disc. As a result, it is possible to visually inspect the first and second hook elements 42, 44 and confirm whether they are correctly engaged with the hooks of the disc prior to fitting of the blades. In service, this also allows the blade flanks to be inspected without completely removing the annulus fillers and thrust ring.

Alternatively, the frame 40 may be connected after fitting of the blades. Since the frame 40 is narrower than the gap between adjacent blades, there is a gap either side of the frame 40 which again allows visual inspection of the first and second hook elements 42, 44 to confirm that they are correctly engaged with the hooks of the disc.

It should be appreciated that not all of the frame 40 need be narrower than the gap between adjacent blades and that alternatively only those elements which would otherwise restrict the view of the first and second hook elements 42, 44 may be narrower, particularly the pair of upstanding members 50 and the bridging member 52. As can be seen in FIG. 2, the connection portions 46 do not directly overlie the first and second hook elements 42, 44 and therefore the first and second hook elements could be visible even if the connection portions 46 were of comparable width to the gap between adjacent blades.

Figure 3:
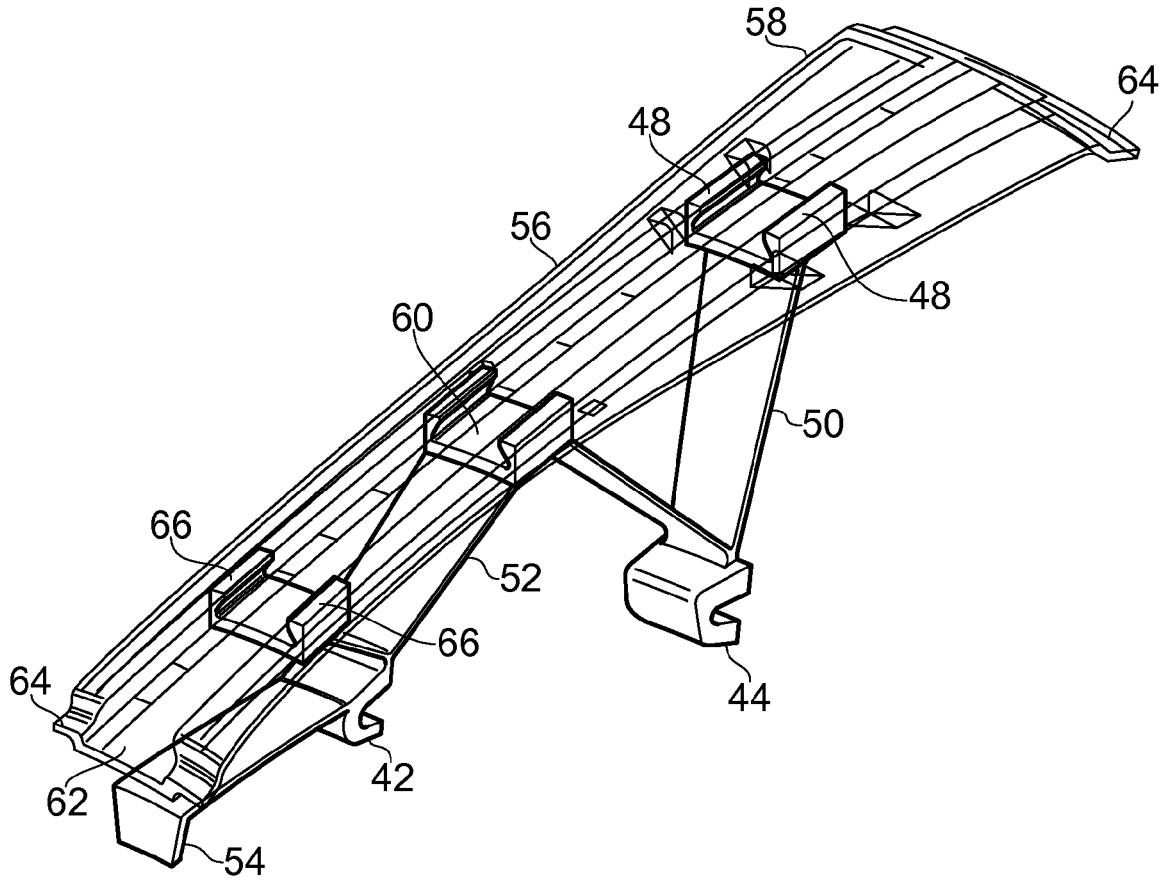
FIG. 3 is a perspective view of the annulus filler assembly of FIG. 2 in a second stage of assembly.

Referring now to FIG. 3, the annulus filler assembly is shown in a second stage of assembly. An annulus lid 56 is provided, which is constructed from a carbon-fibre reinforced plastic composite material and having a radially outwardly facing surface 58 for forming the inner wall of the flow annulus. The annulus lid 56 comprises three apertures 60 extending therethrough and a channel 62 running axially through the radially outwardly facing surface 58. Each axial end of the annulus lid 56 is provided with a tongue 64 which is received under a lip portion of an adjacent casing component, such as the cover portion 28 and rotating seal element 34 as shown in FIG. 1. In other embodiments the annulus lid may alternatively be made from a metallic material.

The annulus lid 56 is located onto the frame 40 such that the three connection portions 46 are received through the apertures 60. The shoulders 48 of each connection portion 46 sit substantially flush with the radially outwardly facing surface 58 and a base of the recess 49 of the connection portion sits substantially flush with a base of the channel 62.

Alternatively, each aperture 60 may comprise two distinct openings 66 on either side of the channel 62 for receiving each of the shoulders 48 of a connection portion 46. In this configuration the base of the recess 49 is separated from the channel 62 by the base of the channel. To compensate for the offset in the radial position of the base of the recess 49, the shoulders 48 are radially taller so that they again sit flush with the radially outwardly facing surface 58.

In either configuration, the shoulders 48 and optionally the base of the recess 49 of the frame 40 are visible from radially outwards of the surface 58, thus providing a visual confirmation that the connection portions 46 are correctly located in the apertures 60.

Figure 4:
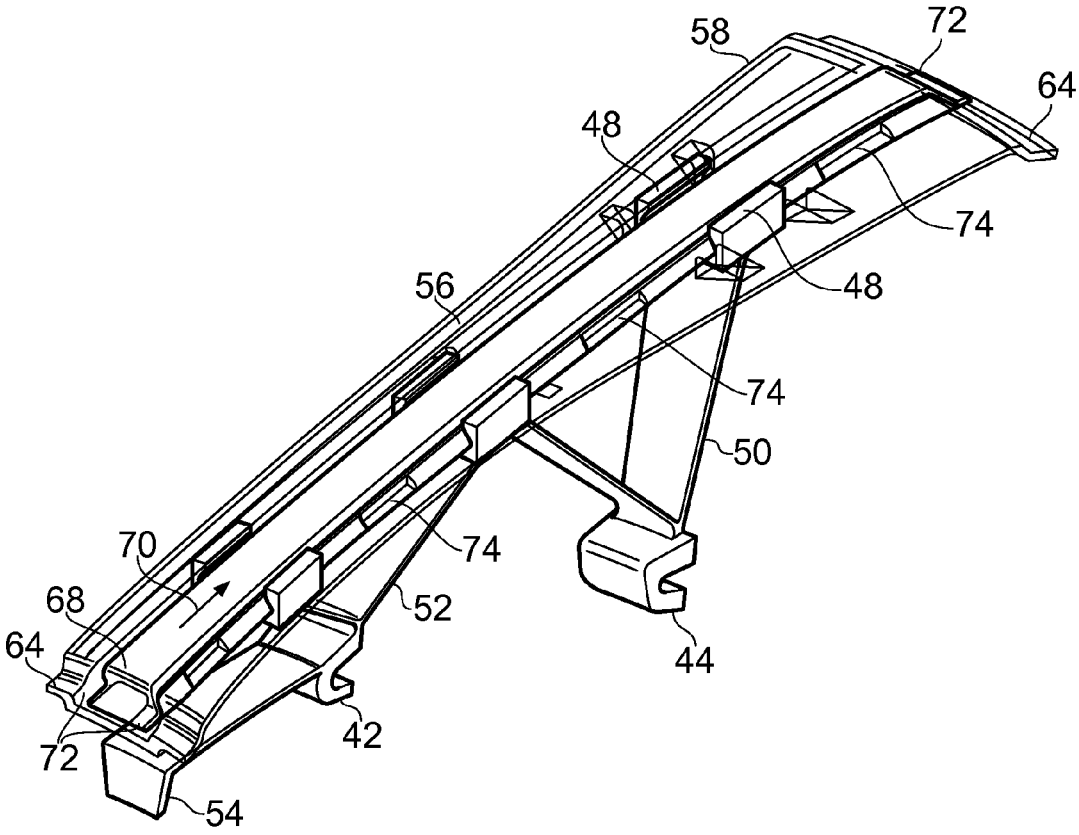
FIG. 4 is a perspective view of the annulus filler assembly of FIG. 2 in a final stage of assembly.

Referring now to FIG. 4, the annulus filler assembly is shown in a final stage of assembly. An elongate slider element 68 which is sized to be received in the channel 62 is introduced into the channel 62 by sliding the slider element 68 from an axially foremost end of the annulus lid 56 towards an axially rearmost end of the annulus lid 56, as indicated by arrow 70. The slider element 68 has a degree of flexibility which allows the slider element to form to the curvature of the annulus lid 56.

As the slider element 68 is slid through the channel 62 it passes through the shoulders 66 of each connection portion in turn. The slider element 68 has a male dovetail cross-section, such that when the slider element 68 is received in the connection portion 46 the two elements interlock to prevent the connection portion 46 from being withdrawn through the aperture 60. Each axial end of the slider element 68 is provided with a bifurcated tongue 72. Similarly to the tongues 64 of the annulus lid 56, the tongues 72 are received under a lip portion of an adjacent casing component, such as the cover portion 28 and rotating seal element 34 as shown in FIG. 1. The cover portion 28 and rotating seal element 34 fix the axial position of the slider element 68 in relation to the annulus lid 56 and thus prevent movement during operation.

As discussed previously, when correctly located, the shoulders 48 of the connection portions 46 sit substantially flush with the radially outwardly facing surface 58. This therefore allows visual inspection before sliding the slider element 68 through the channel 62.

Where the connection portions 46 are not maintained in the correct position as the slider element 68 is slid through the channel 62, depending on the degree of misalignment, the following outcomes will result:

If misalignment is minor, the slider element 68 will be received sufficiently within the connection portion 46 and thus force the connection portion 46 radially outwards (or the annulus lid 56 radially inwards) through contact between the shoulders 48 of the connection portion 46 and the slider element 68, particularly the tongue 72 of the slider element 68, and thus any misalignment will be corrected;

If misalignment is moderate, the tongue 72 of the slider element 68 will contact the shoulders 48 and prevent the slider element 68 from sliding further;

If the misalignment is severe, an interlocking connection will not be formed and instead the slider element 68 will pass over the connection portion 46 withdrawing the connection portion 46 and shoulders 48 out of the aperture 60.

In the latter case where an interlocking connection is not formed, it is immediately evident from a visual inspection of the radially outwardly facing surface 58 that this is the case since the shoulders 48 are not visible, or if they are visible they are clearly not flush with the radially outwardly facing surface 58. A visual inspection of the radially outwardly facing surface 58 therefore confirms whether the annulus lid 56 is correctly connected to the frame 40 and the assembly is not put into service unless all of the shoulders 48 of the connection portions 46 are visible and flush with the radially outwardly facing surface 58.

The slider element 68 is also provided with three recessed portions 74 spaced across the axial length of the slider element 68. The spacing between the recessed portions 74 corresponds to the spacing between both the apertures 60 and the connection portions 46. The recessed portions are offset from both the apertures 60 and the connection portions 46 when the slider element 68 is in its operative position wherein the tongues 72 of the slider element are axially aligned with the tongues 64 of the annulus lid 56. By sliding the slider element 68 out of the annulus lid 56 (in the opposite direction to arrow 70) by a distance equal to the offset, the recessed portions 74 can be aligned with the connection portions 46 and apertures 60. The recessed portions 74 have the shoulders of the dovetail cross-section removed so that the slider element 68 is narrower along these portions than the distance between the shoulders 48 of the connection portion 46. Therefore, when the recessed portions 74 are aligned in this manner, the slider portion does not interlock with the connection portion 46 and the connection portion 46 can be withdrawn through the aperture 60, thus allowing the removal of the annulus lid 56 from the frame 40 without having to fully extract the slider element 68 from the channel 62.

The reversed technique can also be used to connect the annulus lid 56 to the frame 40. Here, the connection portion 46 is introduced into the aperture 60 when the recessed portions 74 are aligned with the apertures 60 and then the slider element is slid into the operative position to lock the connection portions 46 and prevent subsequent withdrawal. When correctly located, the shoulders 48 of the connection portions 46 sit substantially flush with the radially outwardly facing surface 58. If the shoulders 48 of the connection portions 46 are not visible when the slider element 68 is in the operative position, it is clear that the annulus lid 56 is not correctly connected to the frame 40. Therefore the requirement for visual inspection during all stages of assembly is satisfied with this technique also.

Figure 5:
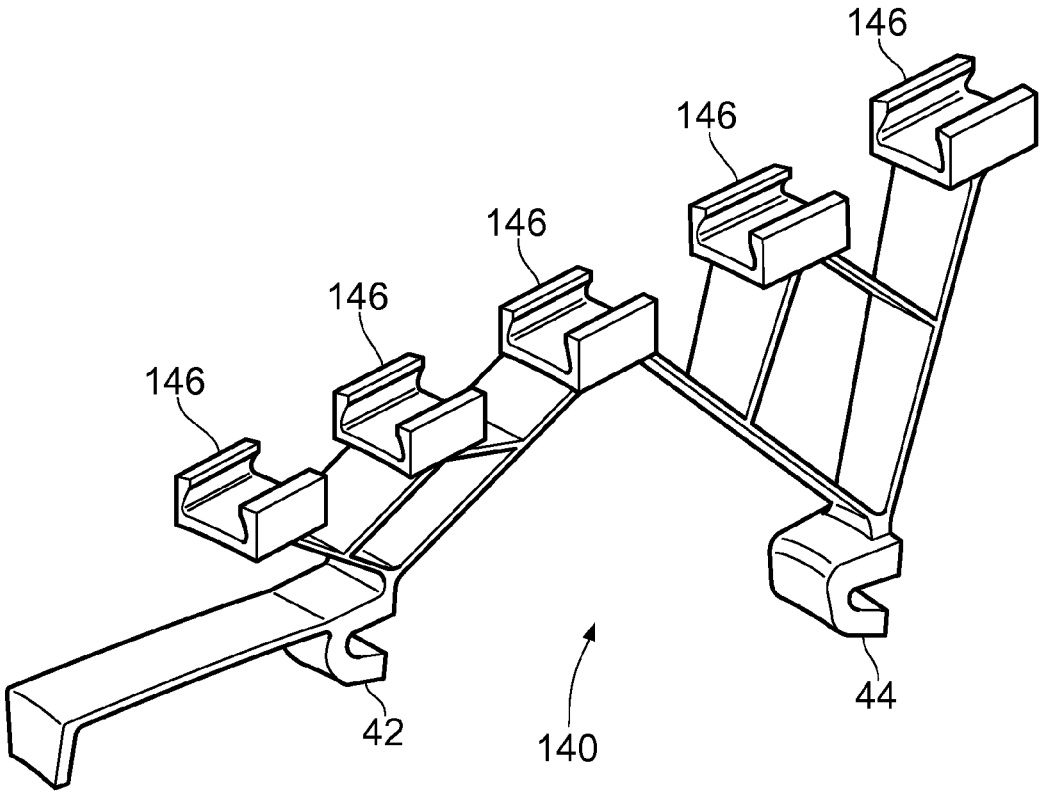
FIG. 5 is a perspective view of an alternative embodiment of an annulus filler in accordance with a first aspect of the invention in a first state of assembly.

FIG. 5 shows an alternative embodiment of a frame 140 for an annulus filler in accordance with a first embodiment of the invention. In contrast to the frame 40 shown in FIG. 2, the frame 140 has five connection portions 146 supported above the first and second hook elements 42, 44 (which are essentially identical to those of the frame of FIG. 2). It will be understood that the slider and lid of this annulus filler, though not shown in the drawings, will be appropriately configured to interlock with the five connection portions 146, in a similar manner to that described for the embodiment of FIG. 2. Because the slider and lid are supported in more places, the stresses and strains in the lid will be reduced, compared with the embodiment having three connector portions.

Figure 6:
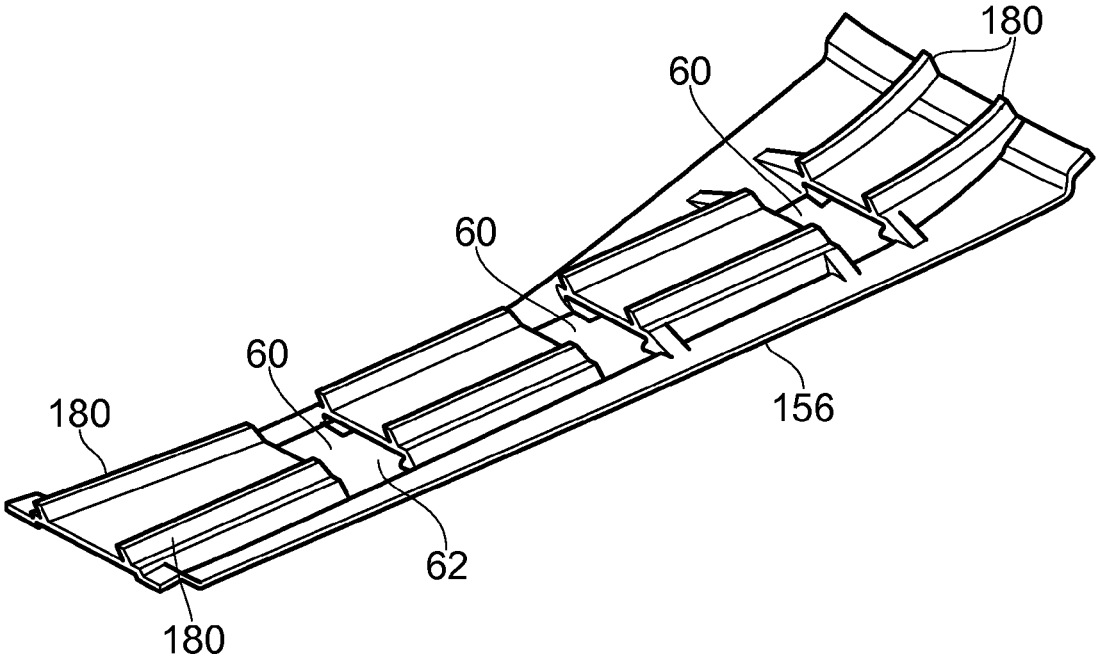
FIG. 6 is a perspective view of part of an alternative embodiment of an annulus filler in accordance with a first aspect of the invention.

FIG. 6 shows the underside of an alternative embodiment of a lid 156 for an annulus filler in accordance with a first aspect of the invention. As with the lid 56 shown in FIG. 3, the lid 156 comprises three apertures 60 extending therethrough, and a channel 62 running axially. In contrast to the lid 56 of FIG. 3, the lid 156 comprises longitudinal ribs 180, which add stiffness to the lid and thereby lower the stresses therein. It will be understood that in other embodiments, different numbers or configurations of ribs or corrugations may be provided to achieve the same result.

Figure 7:
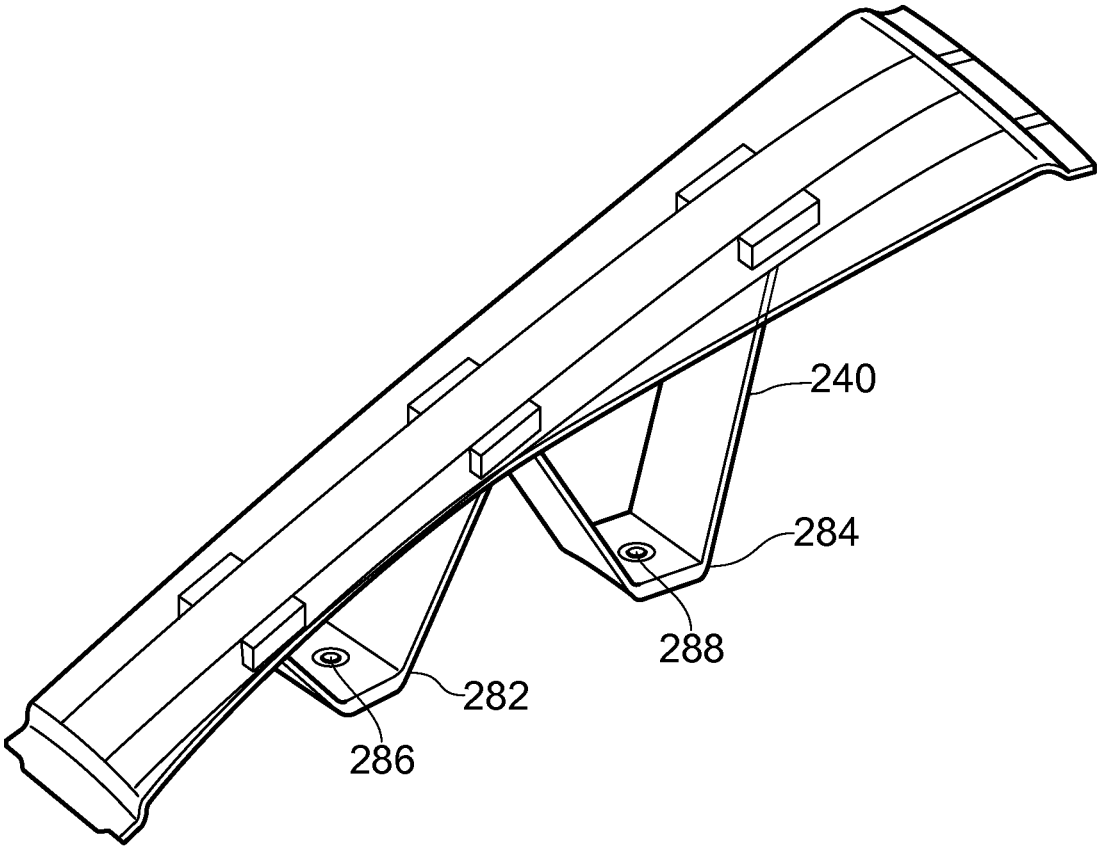
FIG. 7 is a perspective view of the annulus filler assembly of FIG. 6 in a final stage of assembly.

FIG. 7 shows an alternative embodiment of an annulus filler in accordance with a first aspect of the invention. In most respects, this embodiment is similar to that shown in FIG. 4, but the frame 240 of the annulus filler, instead of having first and second hook elements 42, 44 as in FIG. 4, has first and second mounting features 282, 284 comprising holes 286, 288. In use, radial bolts (not shown) extend through the holes 286, 288 to secure the frame 240 to the fan disc. These radial bolts could form part of an axial retention system as described in our pending European patent application EP10168820.2.

It will be appreciated that variations and modifications may be made to the specific arrangement described, without departing from the invention.

For instance, the securing hooks 42, 44 may face each other. The interaction of the slider 68 and the annulus lid 56 and the connection portion 48 may be used to 'lock' the slider and lid in position through centrifugal force.

In another arrangement (not shown in the drawings) the hooks 42, 44 face away from each other and the lip 54 becomes a secondary locking mechanism.

The invention claimed is:

1. An annulus filler assembly for a rotor of a turbomachine, the assembly comprising:

an annulus lid having a radially outwardly facing surface for forming an inner wall of a flow annulus of the rotor and a radially inwardly facing surface; and a frame for supporting the annulus lid, the frame being mountable to a disc of the rotor such that the annulus lid is spaced away from the disc, wherein the frame comprises a connection portion which, in use, passes through an aperture in the annulus lid from the radially inwardly facing surface towards the radially outwardly facing surface such that at least a portion of the connection portion is visible from the radially outwardly facing surface;

a locking element locks the connection portion to the annulus lid via the visible portion of the connection portion, the annulus lid includes a recess formed in its radially outwardly facing surface for receiving the locking element such that the locking element and radially outwardly facing surface form a substantially continuous inner wall of the flow annulus, and the recess is a channel extending in an axial direction along the radially outwardly facing surface and the locking element is an elongate member slidably received within the channel.

2. An annulus filler assembly as claimed in claim 1, wherein the frame is narrower than the annulus lid in a circumferential aspect.

3. An annulus filler assembly as claimed in claim 1, wherein the frame comprises a hook portion for mounting the frame to the disc of the rotor.

4. An annulus filler assembly as claimed in claim 1, wherein the annulus lid and frame are constructed from different materials.

5. An annulus filler assembly as claimed in claim 1, wherein the frame is constructed from metal.

6. An annulus filler assembly as claimed in claim 1, wherein the annulus lid is constructed from a composite material.

7. An annulus filler as claimed in claim 1, wherein the connection portion and locking element comprise complementary interlocking surfaces which when interlocked prevent the connection portion from being withdrawn through the aperture.

8. An annulus filler assembly as claimed in claim 7, wherein the connection portion and locking element form a dovetail joint.

9. An annulus filler assembly as claimed in claim 1, wherein the aperture comprises first and second openings through which first and second portions of the connection portion pass and wherein the locking element is inserted between the first and second portions of the connection portion.

10. An annulus filler assembly as claimed in claim 1, wherein the locking element is flexible.

11. An annulus filler assembly as claimed in claim 1, wherein the locking element locks a plurality of connection portions to the annulus lid.

12. A turbomachine comprising an annulus filler assembly as claimed in claim 1.

13. A method of assembling a rotor, the method comprising:

providing a plurality of annulus filler assemblies as claimed in claim 1;

coupling the frames of the annulus filler assemblies to a disc of the rotor;

coupling a plurality of blades to the disc between adjacent frames;

locating the annulus lid of the annulus filler assembly on the frame such that the connection portion passes through the aperture in the annulus lid; and inserting the locking element into the connection portion so as to lock the connection portion to the annulus lid.

* * * * *